US008770991B2

(12) United States Patent
Harao et al.

(10) Patent No.: US 8,770,991 B2
(45) Date of Patent: Jul. 8, 2014

(54) FUSE CONNECTION UNIT

(75) Inventors: Akira Harao, Makinohara (JP); Minoru Kubota, Makinohara (JP)

(73) Assignee: Yazaki Corporation, Tokyo (JP)

( * ) Notice: Subject to any disclaimer, the term of this patent is extended or adjusted under 35 U.S.C. 154(b) by 11 days.

(21) Appl. No.: 13/365,350

(22) Filed: Feb. 3, 2012

(65) Prior Publication Data

US 2012/0202383 A1 Aug. 9, 2012

(30) Foreign Application Priority Data

Feb. 4, 2011 (JP) ..... 2011-023089

(51) Int. Cl.

| | |
|---|---|
| ***H01R 12/00*** | (2006.01) |
| ***H01H 85/22*** | (2006.01) |
| ***H01H 85/56*** | (2006.01) |
| *H01R 13/684* | (2011.01) |
| *H01H 85/147* | (2006.01) |

(52) U.S. Cl.

CPC ..... *H01H 85/56* (2013.01); *H01R 13/684* (2013.01); *H01H 85/22* (2013.01); *H01H 85/147* (2013.01); *Y10S 439/949* (2013.01)

USPC ..... 439/76.2; 439/949

(58) Field of Classification Search

USPC ..... 439/76.1, 76.2, 79, 949; 174/252; 361/704, 712, 713

See application file for complete search history.

(56) References Cited

U.S. PATENT DOCUMENTS

| | | | | |
|---|---|---|---|---|
| 5,229,922 | A * | 7/1993 | Muramatsu et al. | 361/736 |
| 7,101,199 | B2 * | 9/2006 | Yamashita | 439/76.1 |
| 7,172,436 | B2 * | 2/2007 | Uezono | 439/76.2 |
| 7,320,608 | B2 * | 1/2008 | Kubota et al. | 439/76.1 |
| 7,333,337 | B2 * | 2/2008 | Kita | 361/710 |
| 7,553,169 | B2 * | 6/2009 | Kasai | 439/76.2 |
| 7,733,632 | B2 * | 6/2010 | Ito | 361/626 |
| 7,927,111 | B2 * | 4/2011 | Kita | 439/76.2 |
| 8,070,534 | B2 * | 12/2011 | Makino et al. | 439/701 |
| 8,297,988 | B2 * | 10/2012 | Sugiura et al. | 439/76.2 |
| 2004/0184244 | A1 | 9/2004 | Uezono | |
| 2006/0203455 | A1 | 9/2006 | Suzuki et al. | |
| 2010/0263915 | A1 | 10/2010 | Shiraiwa et al. | |
| 2012/0115340 | A1 * | 5/2012 | Yamamoto | 439/78 |

FOREIGN PATENT DOCUMENTS

| | | | |
|---|---|---|---|
| CN | 101939885 | A | 1/2011 |
| JP | 200642583 | A | 2/2006 |
| JP | 2006253428 | A | 9/2006 |
| JP | 2007281138 | A | 10/2007 |
| JP | 2009152443 | A | 7/2009 |

OTHER PUBLICATIONS

Office Action, dated for Jan. 30, 2014, issued by the State Intellectual Property Office of the People's Republic of China in counterpart Chinese Application No. 201210025064.8.

* cited by examiner

*Primary Examiner* — Thanh Tam Le
(74) *Attorney, Agent, or Firm* — Sughrue Mion, PLLC

(57) ABSTRACT

A fuse connection unit includes a metal core substrate that includes a metal core plate and insulation layers formed on front and back faces of the metal core plate, and a fuse block mounted on the metal core substrate. The metal core substrate has a fuse connection terminal part which is projected from an end edge of each of the insulation layers. The fuse block has a fuse connection terminal. The fuse connection terminal part and the fuse connection terminal are configured to be connected to a fuse.

14 Claims, 9 Drawing Sheets

FUSE CONNECTION UNIT

BACKGROUND

The present invention relates to a fuse connection unit to which a fuse can be disconnectably connected.

There is an electric part having a metal core substrate. For example, there is a circuit substrate separately having a substrate for a large current made of a metal core substrate and a substrate for a small current made of a glass epoxy substrate (see, for example, JP-A-2007-281138). In this technique, a large current part constituted by a fuse or a relay is mounted on the substrate for a large current, a small current part constituted by a resistor or a capacitor is mounted on the substrate for a small current, and thereby a countermeasure against heat is to be taken.

In addition, there is one in which a fuse block having a fuse connection terminal to which a fuse is to be disconnectably connected, is mounted on a metal core substrate (see, for example, JP-A-2006-42583 and JP-A-2009-152443). In this technique, the fuse connection terminal is to be connected to a metal plate of the metal core substrate.

Further, there is one in which a heating element formed of an FET is mounted on a metal core substrate (see, for example, JP-A-2006-253428).

Meanwhile, regarding the fuse connection unit to which a fuse is disconnectably connected, in a case where the fuse connection unit has a configuration that a fuse block is mounted on the metal core substrate as described in JP-A-2006-42583 and JP-A-2009-152443, a lead length of the fuse connection terminal provided on the fuse block to the metal core substrate becomes increasing. As a result, a heat at the fuse connection terminal is not able to be preferably transmitted to a metal core substrate. The height of the fuse block is required to be increased so that the entire height of the fuse connection unit becomes increasing.

SUMMARY

The purpose of the invention is to eliminate the above problems and to provide a fuse connection unit which can preferably transmit the heat at the fuse connection terminal to the metal core substrate and of which the size in the vertical direction can be reduced.

The aforementioned purpose of the invention is achieved by the following configurations.

A fuse connection unit includes a metal core substrate that includes a metal core plate and insulation layers formed on front and back faces of the metal core plate, and a fuse block mounted on the metal core substrate. The metal core substrate has a fuse connection terminal part which is projected from an end edge of each of the insulation layers. The fuse block has a fuse connection terminal. The fuse connection terminal part and the fuse connection terminal are configured to be connected to a fuse.

Preferably, the metal core substrate has an inner arrangement part arranged so as to be covered with the insulation layers, and the fuse connection terminal part is formed on a plane flush with the inner arrangement part.

Here, it is preferable that, the fuse is connected to the fuse connection terminal part from the opposite side of the inner arrangement part along a protruding direction of the fuse connection terminal part.

Here, it is preferable that, the inner arrangement part supports the fuse connection terminal part so as to receive an insertion force of the fuse through the fuse connection terminal part when the fuse is connected to the fuse connection terminal part.

By the above configuration, a part of the metal plate of the metal core substrate is projected from the end edge of each of the insulation layers to form the fuse connection terminal part. By forming the fuse connection terminal part on the metal plate, a lead length of the fuse connection terminal part can be reduced. In addition, since a remaining fuse connection terminal part can be brought into close proximity to the metal core substrate, a lead length thereof can be also reduced. Therefore, a heat at the fuse connection terminal part can be preferably transmitted to a metal core substrate side. As a result, reduction of the heat at the fuse block can be achieved, so that thermal interference between the fuse connection terminal parts or a decrease in function of the fuse connection terminal part such as lowering of its mechanical strength or the like can be suppressed.

Further, since the number of fuse connection terminals of the fuse block can be decreased, the height of the fuse block can be reduced and the size in the vertical direction can be reduced. In addition, since the number of fuse connection terminals assembled to the fuse block can be decreased, the assembling of the fuse block can be simplified.

Also, by the above configuration, the fuse connection terminal part of the metal plate is so constituted that the entirety thereof protruding from the insulation layer is formed on the plane flush with the inner arrangement section which is covered with the insulation layers. Therefore, in a case where a fuse is connected along the protruding direction from the opposite side of the inner arrangement part, a force is applied to the fuse connection terminal part in the direction of the inner arrangement part, the fuse connection terminal part being formed on a plane flush with the inner arrangement part and being disposed to face in the direction opposite to the inner arrangement part, so that deformation of the fuse connection terminal part can be suppressed.

ADVANTAGEOUS EFFECTS OF THE INVENTION

In accordance with the invention, it is possible to provide the fuse connection unit in which the heat at the fuse connection terminal can be preferably transmitted to the metal core substrate side and the size in the vertical direction can be reduced.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 3A and 3B are schematic views showing a pre-stage of a manufacturing process of the metal core substrate of the fuse connection unit according to the embodiment, wherein FIG. 3A is a plan view of the metal core substrate of the fuse connection unit and FIG. 3B is a side elevational view of the metal core substrate of the fuse connection unit;

FIGS. 4A and 4B are schematic views showing an intermediate stage of the manufacturing process of the metal core substrate of the fuse connection unit according to the embodiment, wherein FIG. 4A is a plan view of the metal core substrate of the fuse connection unit and FIG. 4B is a side elevational view of the metal core substrate of the fuse connection unit;

FIGS. 5A and 5B are schematic views showing a post-stage of the manufacturing process of the metal core substrate of the fuse connection unit according to the embodiment, wherein FIG. 5A is a plan view of the metal core substrate of the fuse connection unit and FIG. 5B is a side elevational view of the metal core substrate of the fuse connection unit;

DETAILED DESCRIPTION OF EXEMPLARY EMBODIMENTS

A fuse connection unit according to an embodiment of the invention is described below with reference to accompanying drawings.

Figure 1:
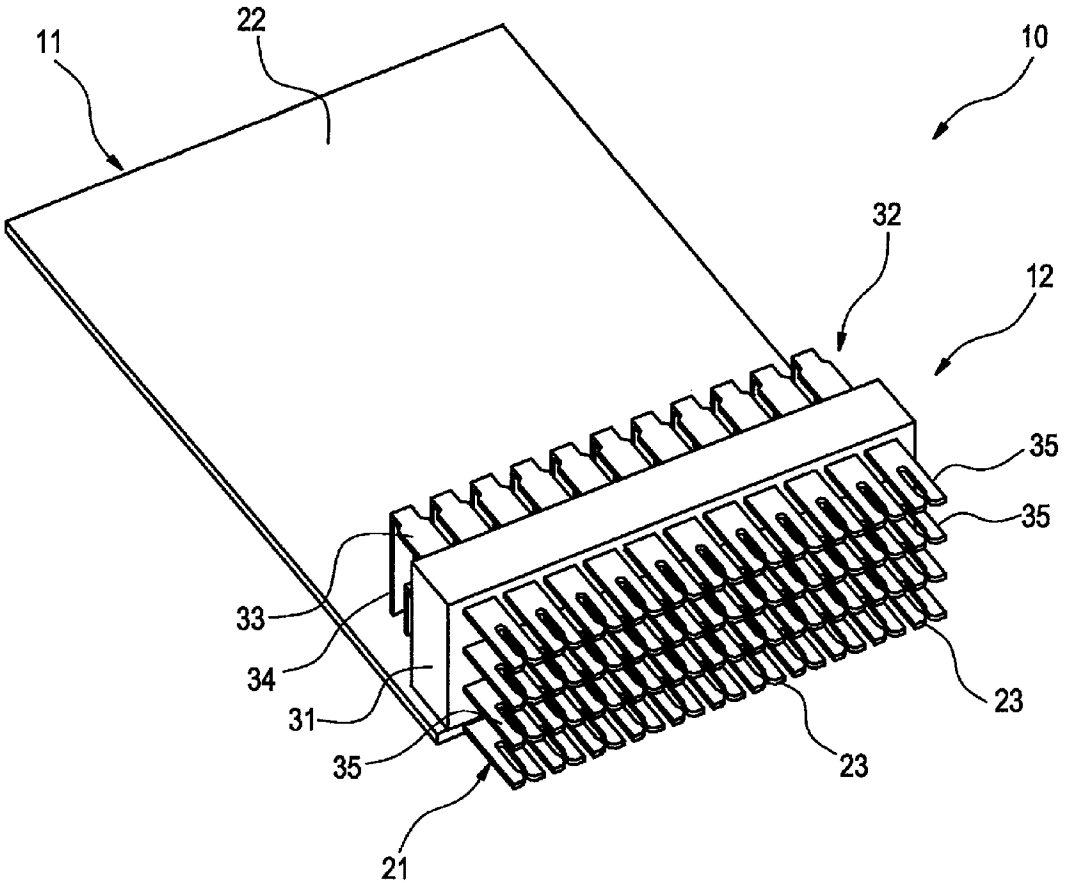
FIG. 1 is a perspective view showing a fuse connection unit according to an embodiment of the invention.
Figure 2:
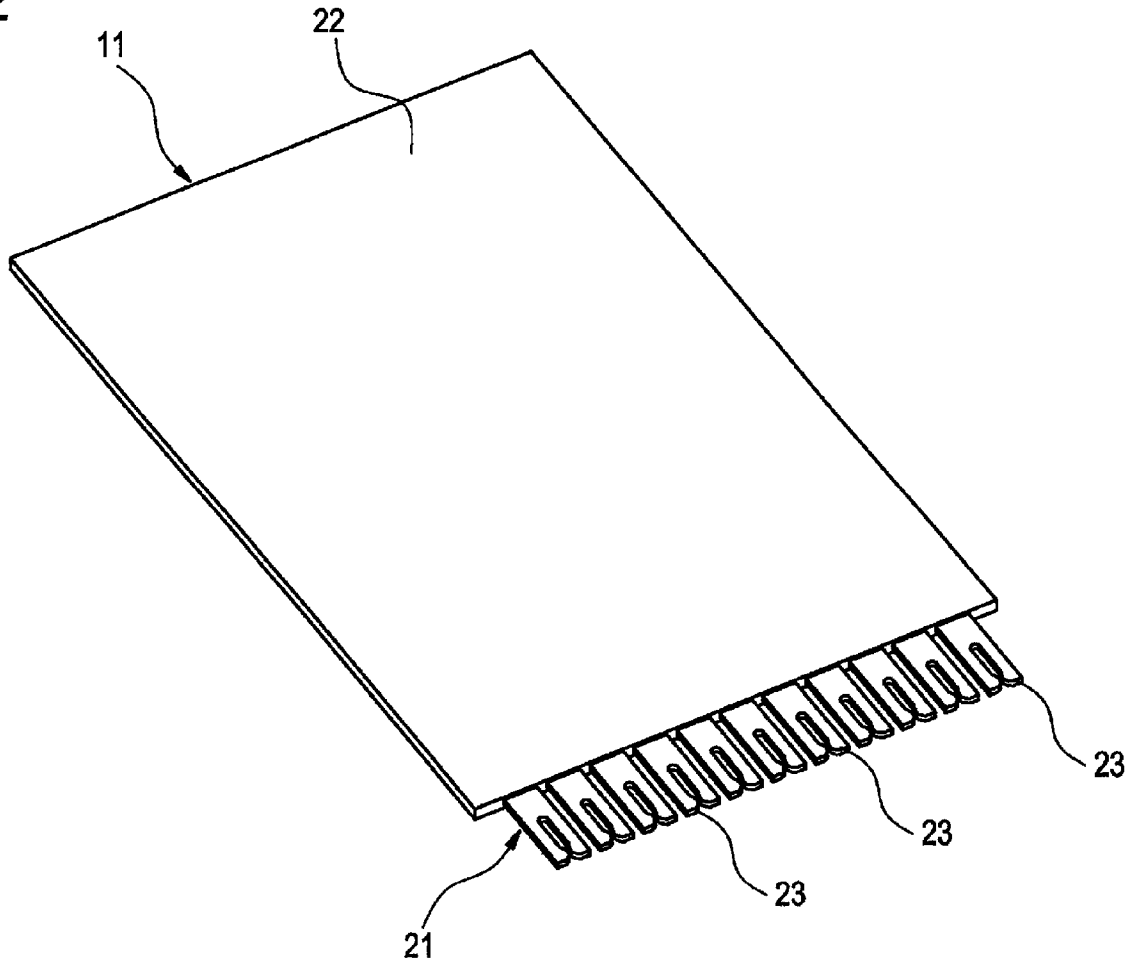
FIG. 2 is a perspective view showing a metal core substrate of the fuse connection unit according to the embodiment.
Figure 3A:
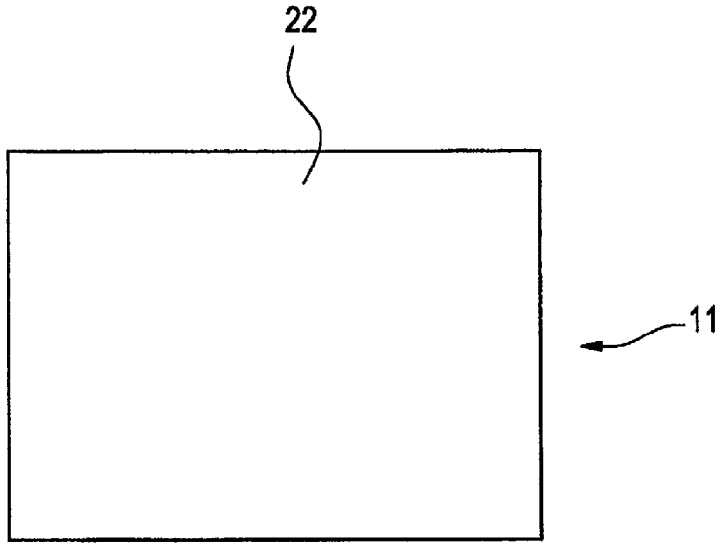
Figure 3B:
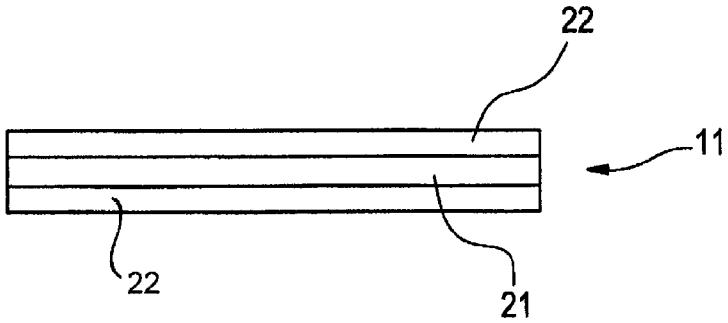
Figure 4A:
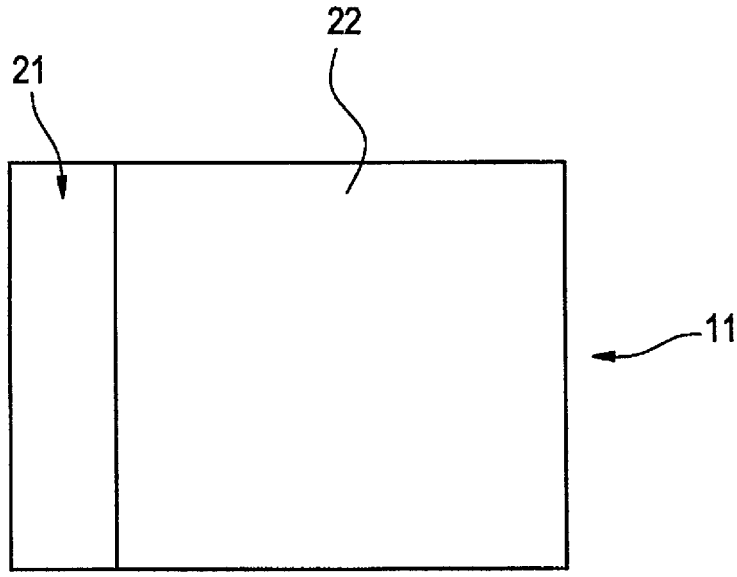
Figure 4B:
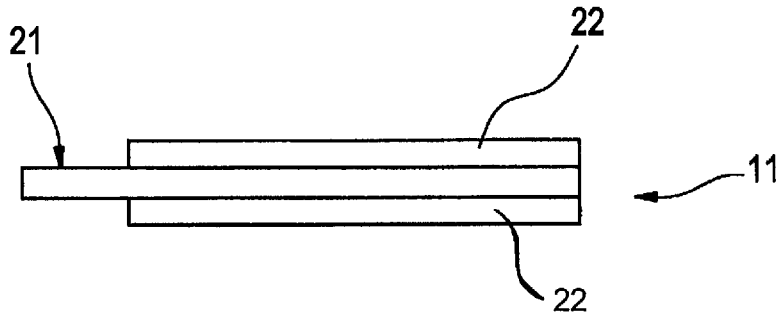
Figure 5A:
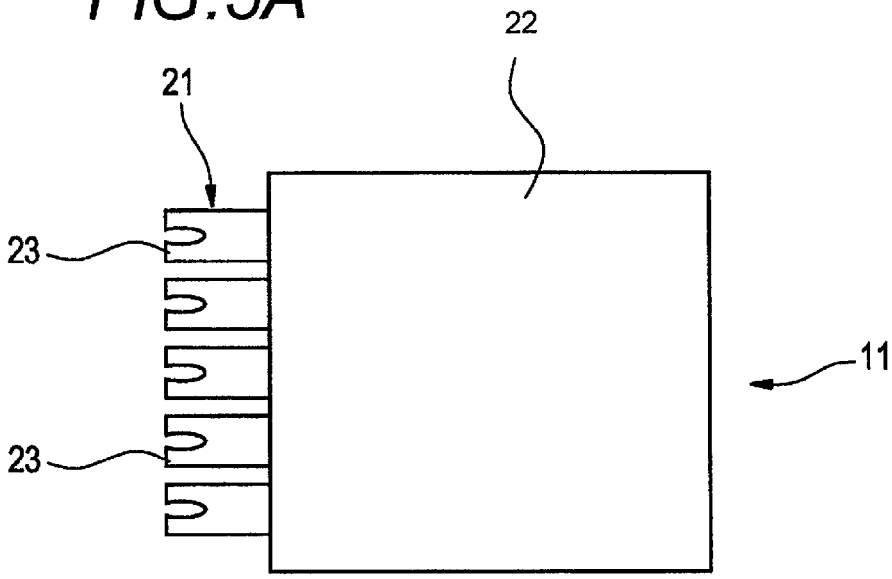
Figure 5B:
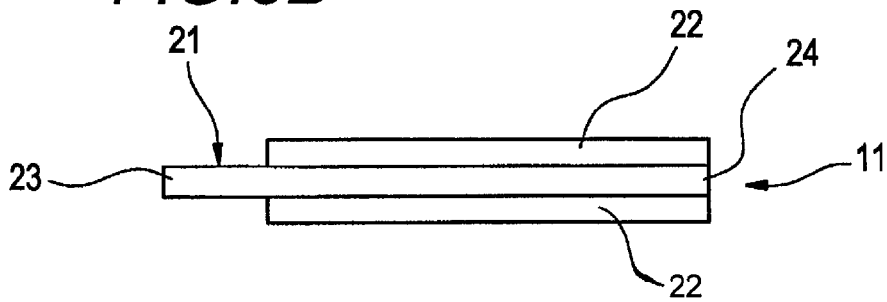
Figure 6:
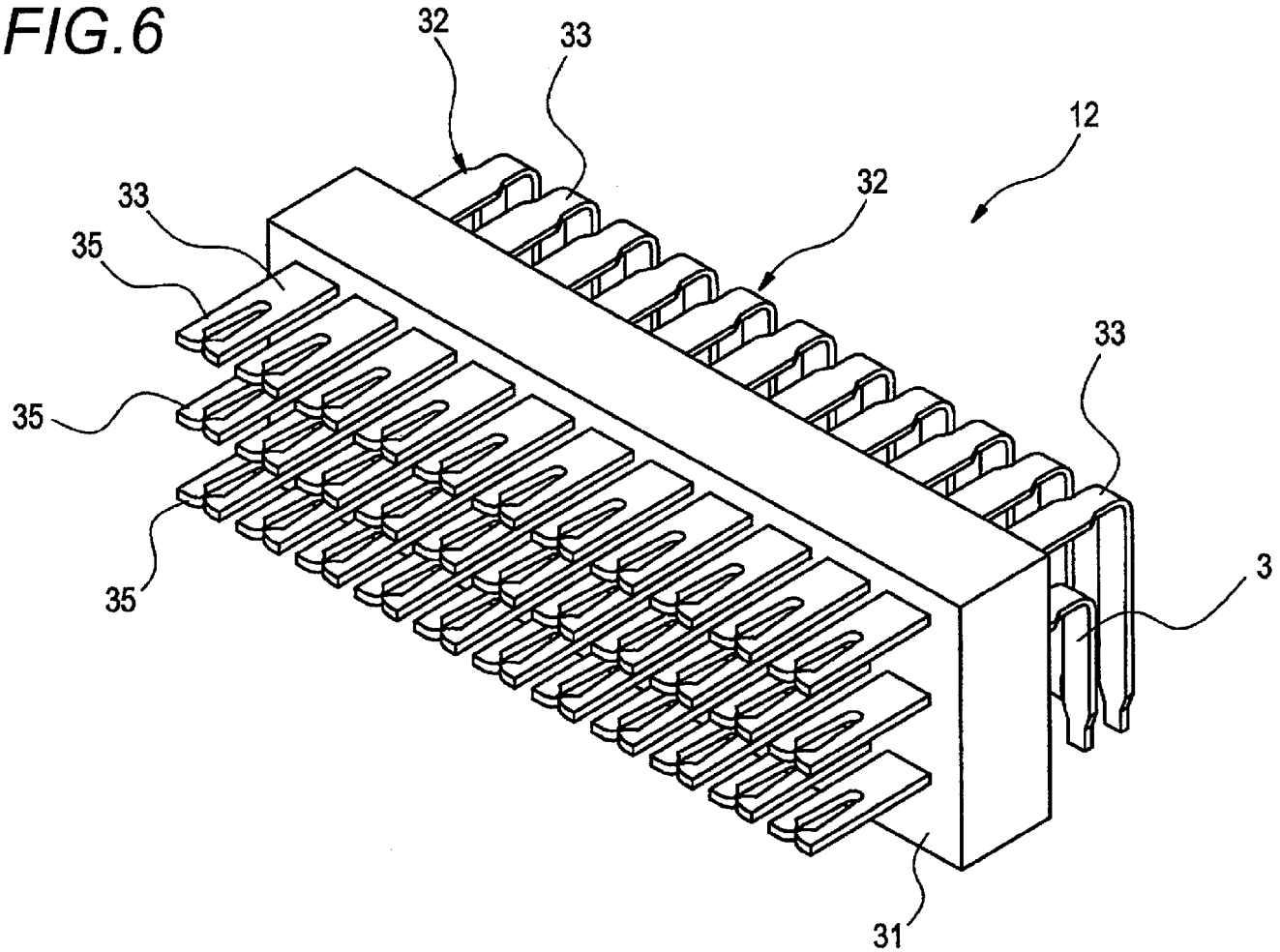
FIG. 6 is a perspective view showing a fuse block of the fuse connection unit according to the embodiment.
Figure 7:
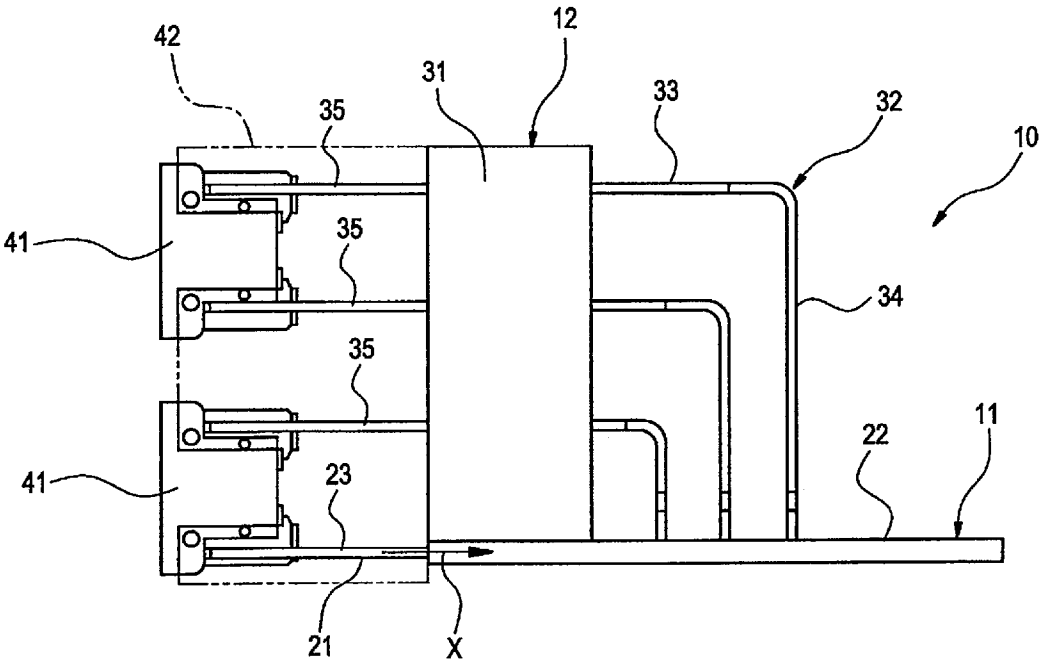
FIG. 7 is a side elevational view showing a state in which a fuse is connected to the fuse connection unit according to the embodiment.
Figure 8:
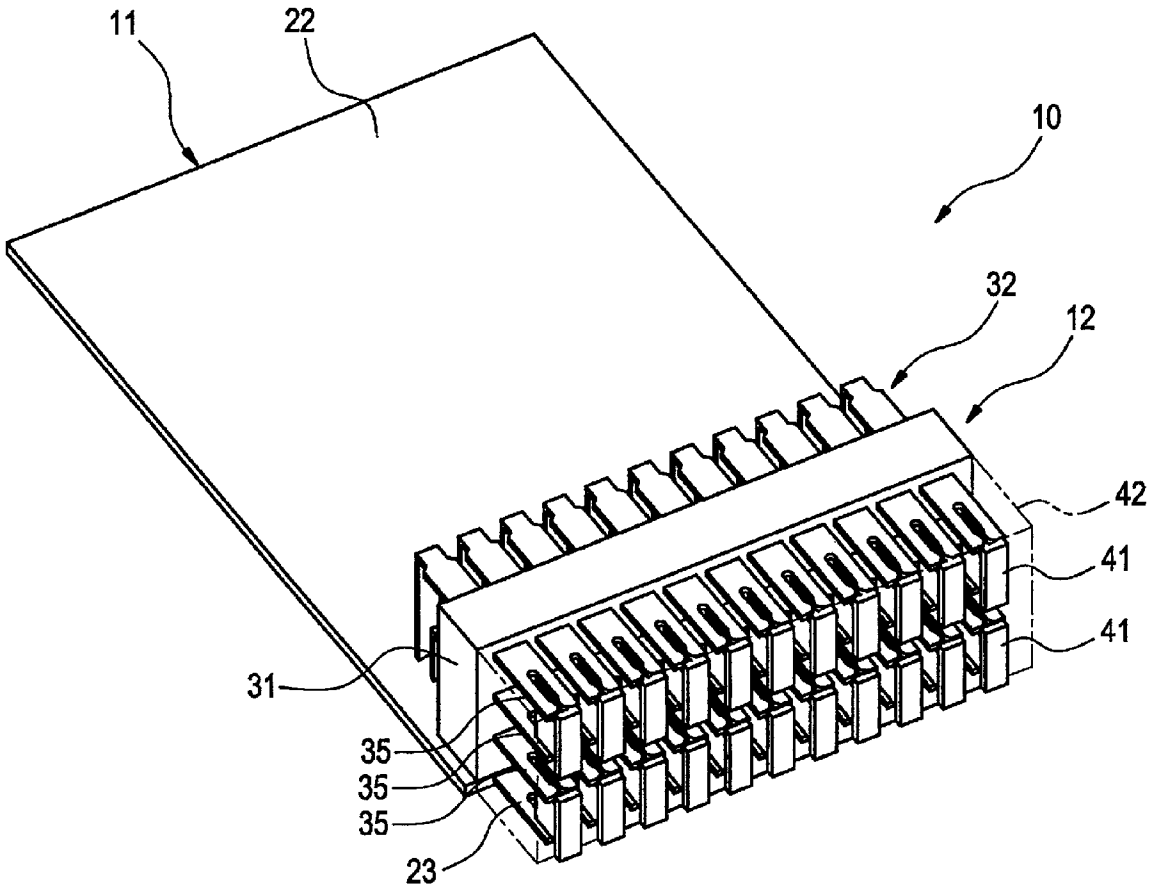
FIG. 8 is a perspective view showing the state in which the fuse is connected to the fuse connection unit according to the embodiment.
Figure 9A:
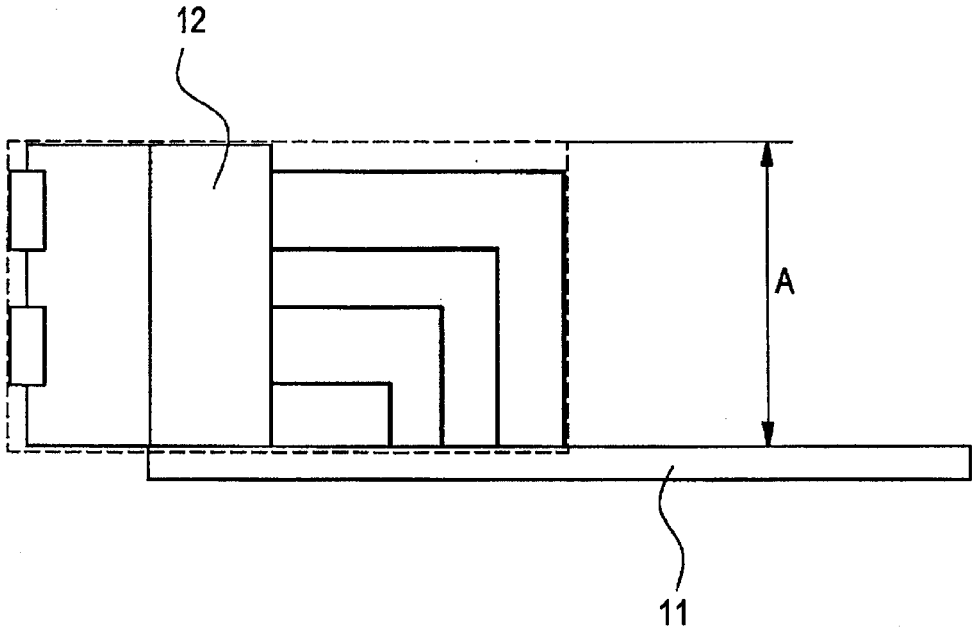
FIG. 9A is a side elevational view showing a structure of a related art and FIG. 9B is a side elevational view showing the fuse connection unit according to the embodiment.
Figure 9B:
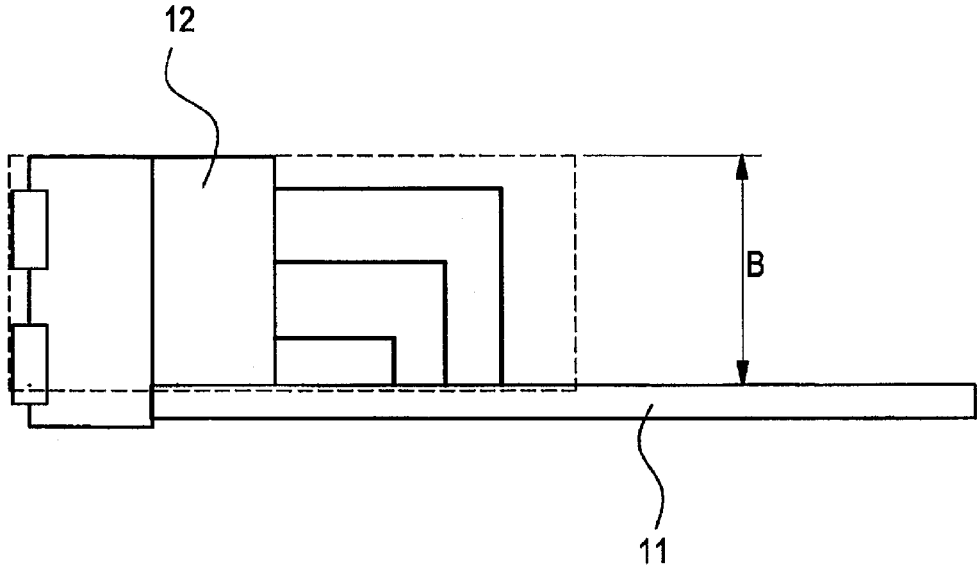

FIG. 1 is a perspective view showing the fuse connection unit according to an embodiment of the invention, FIG. 2 is a perspective view showing a metal core substrate of the fuse connection unit according to the embodiment, FIGS. 3A and 3B are schematic views showing a pre-stage of a manufacturing process of the metal core substrate of the fuse connection unit according to the embodiment, FIGS. 4A and 4B are schematic views showing an intermediate stage of the manufacturing process of the metal core substrate of the fuse connection unit according to the embodiment, FIGS. 5A and 5B are schematic views showing a post-stage of the manufacturing process of the metal core substrate of the fuse connection unit according to the embodiment, FIG. 6 is a perspective view showing a fuse block of the fuse connection unit according to the embodiment, FIG. 7 is a side elevational view showing a state in which a fuse is connected to the fuse connection unit according to the embodiment, FIG. 8 is a perspective view showing the state in which the fuse is connected to the fuse connection unit according to the embodiment, FIG. 9A is a side elevational view showing a structure of the related art, and FIG. 9B is a side elevational view showing the fuse connection unit according to the embodiment.

As shown in FIG. 1, a fuse connection unit 10 according to the embodiment, includes a metal core substrate 11, and a fuse block 12 mounted on the metal core substrate 11.

As shown in FIG. 2, the metal core substrate 11 has a flat metal plate 21 (a metal core late) to be a core and insulation layers 22 formed at front and back faces of the metal plate 21. The metal plate 21 is formed of conductive metal. To be specific, the metal plate 21 is made of, for example, a copper alloy having a thermal characteristic, a mechanical characteristic and a thickness, and the insulation layers 22 is made of an insulative synthetic resin.

The metal plate 21 is so configured that a part thereof protrudes from an end edge of each of the insulation layers 22 so as to form a plurality of fuse connection terminals 23 (fuse connection terminal parts). The fuse connection terminals 23 are arranged along the end edge of each of the insulation layers 22. Each of the fuse connection terminals 23 is formed in a tuning fork shape.

In a case where the metal core substrate 11 is manufactured as shown in FIGS. 3 to 5, the insulation layers 22 are formed on both surfaces of the metal plate 21 as shown in FIGS. 3A and 3B. Next, a part of each of the insulation layers 22 is cut so as to allow the metal plate 21 to protrude from the end edge of each of the insulation layers 22 as shown in FIGS. 4A and 4B. After that, the plurality of tuning fork shaped fuse connection terminals 23 are formed on the part which protrudes from the insulation layers 22 of the metal plate 21 so as to be exposed at the outside thereof, as shown in FIGS. 5A and 5B. At that time, for example, an unnecessary part is removed from the metal plate 21 by a press processing using a die so as to form the plurality of fuse connection terminals 23.

All of the fuse connection terminals 23 are integrally formed with an insulation layer-inner placement part 24 (an inner arrangement part) which is arranged in the insulation layers 22 of the metal plate 21. The entireties of the fuse connection terminals 23 protruding from the insulation layers 22 are formed on a plane flush with the insulation layer-inner placement part 24. Each of the fuse connection terminals 23 is formed in a tuning fork shape on its plane and is disposed to face in the opposite direction of the insulation layer-inner placement part 24.

As shown in FIG. 6, the fuse block 12 has a fuse block body 31 made of an insulative synthetic resin and a plurality of terminal forming members 32 supported by the fuse block body 31. Each of the terminal forming members 32 is formed to have a terminal forming part 33 at one side and a leg section 34 at the other side, the terminal forming part 33 being bent so as to be perpendicular to the terminal forming part 33, thereby being formed in an L-shape. The terminal forming members 32 are inserted into and supported by the fuse block body 31 so that the terminal forming part 33 are parallel to each other. In each of the terminal forming parts 33, a part protruding to the opposite side of each leg section 34, is made to be a fuse connection terminal 35 formed in a tuning fork shape. In this embodiment, the fuse connection terminals 35 are arranged in a matrix of 11 columns and 3 rows.

As shown in FIGS. 1 and 7, the fuse block 12 is mounted on the insulation layer 22 of the metal core substrate 11 in the fuse block body 31. At that time, the leg sections 34 of the terminal forming members 32 are connected to a circuit pattern (not shown) formed on the metal core substrate 11.

All of the fuse connection terminals 35 of the fuse block 12 in a state that the fuse block 12 is mounted on the metal core substrate 11 are arranged in parallel to the fuse connection terminals 23 of the metal plate 21. In the fuse block 12, the fuse connection terminals 35 arranged in one row at the nearest side to the metal core substrate 11 and the fuse connection terminals 23 of the metal plate 21 are configured such that each pair of fuse connection terminals 35 and 23 of which the positions are matched with each other in the arrangement direction, form a set. In addition, the fuse connection terminals 35 of the fuse block 12 which are arranged in two rows except the fuse connection terminals 35 arranged at the nearest side to the metal core substrate 11, are configured such that each pair of the two rows of the fuse connection terminals 35 which are matched in position with each other in the arrangement direction, also form a set.

As shown in FIGS. 7 and 8, a fuse 41 is fitted to each of the sets of the fuse connection terminals 23 and 35 along the protruding direction of the fuse connection terminals 23 and 35 from the opposite side of the protruding direction. The fuses 41 are to be pulled out from the fuse connection terminals 23 and 35 along the protruding direction. That is, the fuses 41 are to be disconnectably connected to the fuse connection terminals 23 of the metal plate 21 and the fuse connection terminals 35 provided on the fuse block 12. The fuse 41 is fitted to each of the sets of pairs of the fuse connection terminals 35 along the protruding direction from the opposite side of the protruding direction. These fuses 41 are also to be pulled out from the fuse connection terminals 35.

Meanwhile, in a practical case, a fuse attachment section 42 for partitioning sections to which the fuses 41 are attached, is coupled to the fuse block body 31 as shown in FIGS. 7 and 8 by an imaginary line.

In accordance with the above described fuse connection unit 10, the part of the metal plate 21 of the metal core substrate 11 is projected from the end edge of each of the insulation layers 22 so as to form the fuse connection terminals 23. By forming the fuse connection terminals 23 on the metal plate 21 as in the above, the lead lengths of the fuse connection terminals 23 can be reduced. In addition, since the remaining fuse connection terminals 35 can be brought into close proximity to the metal core substrate 11, the lead lengths of the remaining fuse connection terminals 23 can be also reduced.

Accordingly, the heat generated on contact points between the fuse connection terminals 23 and 35 and the fuses 41 can be preferably transmitted to the metal core substrate 11 as shown, for example, in FIG. 7 by arrow X. Therefore, the reduction of the heat of the fuse block 12 can be achieved, so that thermal interference between the fuse connection terminals or decrease in function such as lowering of the mechanical strength of the fuse connection terminals or the like can be suppressed.

By moving the one row of the fuse connection terminals to the metal core substrate 11 from the fuse block 12 as described above, the number of fuse connection terminals 23 of the fuse block 12 can be reduced. Accordingly, the height B of the fuse block 12 can be reduced as shown in FIG. 9B by one row of the fuse connection terminals moved to the metal core substrate 11 with respect to the height A of the fuse block 12 having a conventional structure shown in FIG. 9A.

As a result, the whole height of the fuse connection unit can be reduced so that reduction of the size thereof in the vertical direction can be achieved. That is, when the fuse connection unit 10 is used for, for example, a power supply box, thinning of the power supply box can be achieved. In addition, since the assembling number of the terminal forming members 32 including the fuse connection terminals 35 assembled to the fuse block 12 can be reduced, the assembling of the fuse block can be simplified.

Further, the fuse connection terminals 23 of the metal plate 21 are so configured that the parts of the fuse connection terminals 23 protruding from the insulation layers 22 are formed on the plane flush with the insulation layer-inner placement part 24 which is arranged in the insulation layers 22 of the metal plate 21. Therefore, forming of the fuse connection terminals 23 of the metal plate 21 can be facilitated.

Moreover, the fuse connection terminals 23 of the metal plate 21 are formed on the plane flush with the insulation layer-inner placement part 24 and are disposed to face in the opposite direction thereof. Therefore, in a case where the fuse 41 is connected from the opposite side along the protruding direction, a force is applied in the direction to the insulation layer-inner placement part 24 which is flush with fuse connection terminals 23 so that deformation of the fuse connection terminal 23 can be suppressed.

Meanwhile, the invention is not limited to the above embodiment, but changes, modifications or the like can be made if necessary. Other than that, a material, a shape and a dimension of each element, the number of elements, a placement position of each element and the like in the above embodiment are arbitrary as long as the invention can be achieved so that they are not limited.

The present application is based on Japanese Patent Application No. 2011-023089 filed on Feb. 4, 2011, the contents of which are incorporated herein by reference.

What is claimed is:

1. A fuse connection unit comprising:

a metal core substrate that includes a metal core plate and insulation layers formed on front and back faces of the metal core plate; and a fuse block mounted on the metal core substrate, wherein the metal core substrate has a fuse connection terminal part which is projected from an end edge of each of the insulation layers and the metal core plate;

wherein the fuse block has a fuse connection terminal that is directly connected to the metal core substrate; and wherein the fuse connection terminal part and the fuse connection terminal are configured to be connected to a fuse.

2. The fuse connection unit according to claim 1, wherein the metal core substrate has an inner arrangement part arranged so as to be covered with the insulation layers; and wherein the fuse connection terminal part is formed on a plane flush with the inner arrangement part.

3. The fuse connection unit according to claim 2, wherein the fuse is connected to the fuse connection terminal part from the opposite side of the inner arrangement part along a protruding direction of the fuse connection terminal part.

4. The fuse connection unit according to claim 3, wherein the inner arrangement part supports the fuse connection terminal part so as to receive an insertion force of the fuse through the fuse connection terminal part when the fuse is connected to the fuse connection terminal part.

5. The fuse connection unit according to claim 1, wherein the metal core plate has a length in a first direction that is greater than a length of the insulation layers in the first direction, and wherein the fuse connection terminal part is projected from the end edge of the insulating layers in the first direction.

6. The fuse connection unit according to claim 1, wherein the metal core plate has a width that is substantially the same as that of the insulation layers.

7. The fuse connection unit according to claim 6, wherein the metal core plate has length that is greater than that of the insulation layers.

8. The fuse connection unit according to claim 1, wherein the fuse block is mounted on a top surface of one of the insulation layers.

9. The fuse connection unit according to claim 1, wherein the fuse connection terminal part includes a first plurality of fuse connection terminals from the metal core plate.

10. The fuse connection unit according to claim 9, wherein the fuse block includes a second plurality of fuse connection terminals.

11. The fuse connection unit according to claim 10, further comprising a plurality of connection terminal pairs each configured to be connected to a respective fuse, wherein each of the connection terminal pairs includes one of the first plurality of terminals and one of the second plurality of terminals.

12. A fuse connection unit comprising:

a substrate that includes:

a first insulating layer;

a second insulating layer; and a metal layer interposed between the first and second insulating layers, the metal layer including a row of first fuse connection terminals that extend beyond the first and second insulating layers in a first direction; and a fuse block mounted on the substrate, the fuse block including a row of second fuse connection terminals that are directly connected to the substrate, wherein a connectional terminal pair including one of the first fuse connection terminals and one of the second fuse connection terminals configured to be connected to a fuse.

13. The fuse connection unit according to claim 12, wherein the first fuse connection terminals have substantially a same height in a second direction that is orthogonal to the first direction.

14. A fuse connection unit comprising:

a substrate that includes a first fuse connection terminal; and a fuse block mounted on the substrate over a portion of the first fuse connection terminal within the substrate, the fuse block including a second fuse connection terminal that is directly connected to the substrate, wherein the first fuse connection terminal and the second fuse connection terminal are configured to be connected to a fuse, and wherein the substrate further includes an insulating layer interposed between the fuse block and the first fuse connection terminal.

* * * * *